United States Patent [19]

Rock et al.

[11] 4,037,885

[45] July 26, 1977

[54] WITHDRAWAL GUIDE FOR DRAWERS OR THE LIKE

[76] Inventors: Erich Rock, Kuferstrasse 1085, A-6973 Hochst; Bernhard Mages, Harte 10, A-6850 Dornbirn, both of Austria

[21] Appl. No.: 660,317

[22] Filed: Feb. 23, 1976

[30] Foreign Application Priority Data

| | | |
|---|---|---|
| Feb. 25, 1975 | Austria | 1447/75 |
| May 30, 1975 | Austria | 4105/75 |
| July 24, 1975 | Austria | 5750/75 |

[51] Int. Cl.[2] ..... F16C 29/04

[52] U.S. Cl. ..... 308/3.8

[58] Field of Search ..... 308/3.6, 3.8, 202, 215

[56] References Cited

U.S. PATENT DOCUMENTS

| | | | |
|---|---|---|---|
| 2,880,040 | 3/1959 | Gomersall | 308/3.8 |
| 3,301,610 | 1/1967 | Packett et al. | 308/3.8 |
| 3,410,618 | 11/1968 | Harris et al. | 308/215 X |

*Primary Examiner*—Joseph F. Peters, Jr.

*Assistant Examiner*—Gene A. Church

[57] ABSTRACT

A withdrawal guide for drawers in which one support rail is provided at each side of the fixed frame or supporting structure, and one guide rail is present on the drawer. Rollers transmit the vertical forces occurring between the guide rail and the support rail, and the rollers are supported in a roller carrier in the form of a mobile unit. At least one compensating roller is provided in the mobile unit, and the axis of rotation of this compensating roller is normal to the axis of rotation of the rollers. When assembled, the compensating roller runs on the vertical track of the support rail and the guide rail respectively. The compensating roller is held only on its peripheral area without an axle being free to move in radial direction to a predetermined degree. Pegs prevent the compensating roller from falling out of the carrier when the drawer guide rail is pulled out of the support rail. The pegs do not penetrate through the compensating roller but extend, instead, only in a lateral recess in the roller or the roller carrier, so that the compensating roller is snapable in or out of its holding position in the roller carrier.

10 Claims, 6 Drawing Figures

WITHDRAWAL GUIDE FOR DRAWERS OR THE LIKE

BACKGROUND OF THE INVENTION

The invention relates to a withdrawal guide for drawers or the like with one support rail at each side on the fixed structure and one guide rail at each side on the container or drawers, and rollers which transmit the vertical forces occuring between the guide rail and the support rail. The rollers are supported in a roller carrier constituted as a mobile unit.

Withdrawal guides of this kind find their application for drawers but also for working surfaces and the like in modern furniture construction, particularly in many kitchen and office furniture construction applications.

It is generally their task to simplify the pulling out of the drawers and to make this as free from sticking as possible, and also to offer the possibility of holding the drawer in the piece of furniture itself even when almost completely pulled out.

Known drawer guides are in general equipped with rollers, and also with slides, preferably of plastic or with a combination of rollers and slides, and also with freely mobile ball races.

It is the object of the present invention to produce a withdrawal guide of the kind initially mentioned which makes possible a particularly frictionless sliding of the supporting rail of the fixed structure and the guide rail on the drawer one upon the other and which ensures an optimum lateral stability, lateral guidance and quiet movement.

SUMMARY OF THE INVENTION

This is attained in accordance with the invention through the fact that at least one compensating roller is provided in the mobile unit, the rotational axis of which runs normal to the rotational axis of the running rollers, and which when assembled rolls on the vertical track of the support rail and the guide rail respectively.

The mobile unit in accordance with the invention differs substantially from the central rail of known differential withdrawal assemblies, in that it exerts no supporting function itself. The load transmission is effected purely through the rollers. Consequently it is generally advantageous if even when the guide rail is pulled out, the mobile unit remains wholly or at least to a substantial extent within the support rail.

Advantageous provision is made by two compensating rollers being present in the mobile unit.

Embodiment examples of the invention are described below in more detail on the basis of the figures of the attached drawings.

DESCRIPTION OF THE PREFERRED EMBODIMENTS

The withdrawal guide in accordance with the invention consists of a support rail 1 on the fixed structure, which is for example produced with a U-section profile and can be inserted in a groove of the side wall of the structure and also of a guide rail 4 on the drawer.

In the embodiment example the guide rail 4 on the drawer is constituted with a Z-section profile, so that when fitted it extends under the side wall of a drawer.

Obviously it would also be possible to form the guide rail with an L-section profile.

Figure 1:
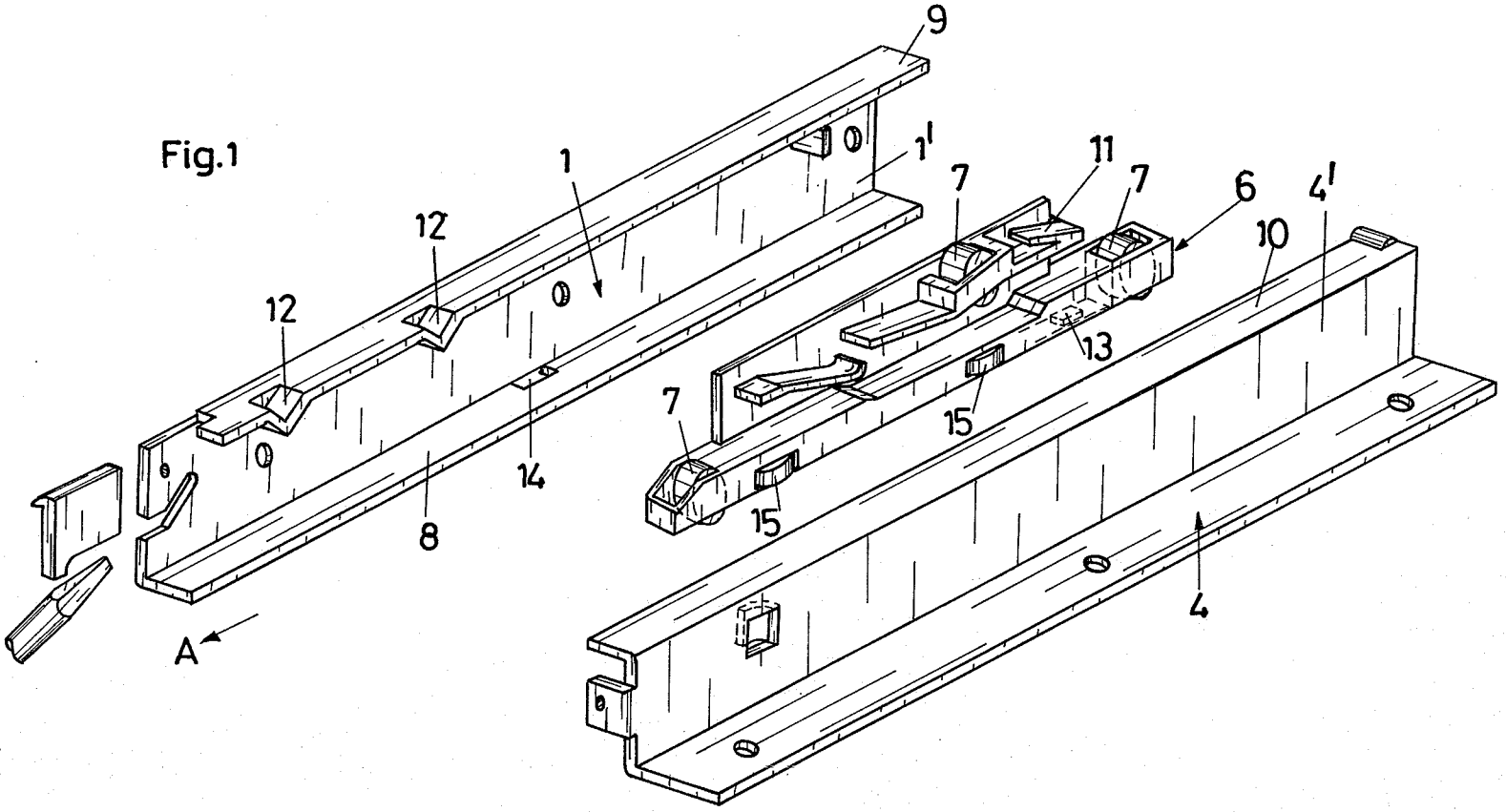
FIG. 1 gives a schematic illustration of the withdrawal guide in accordance with the invention.
Figure 2:
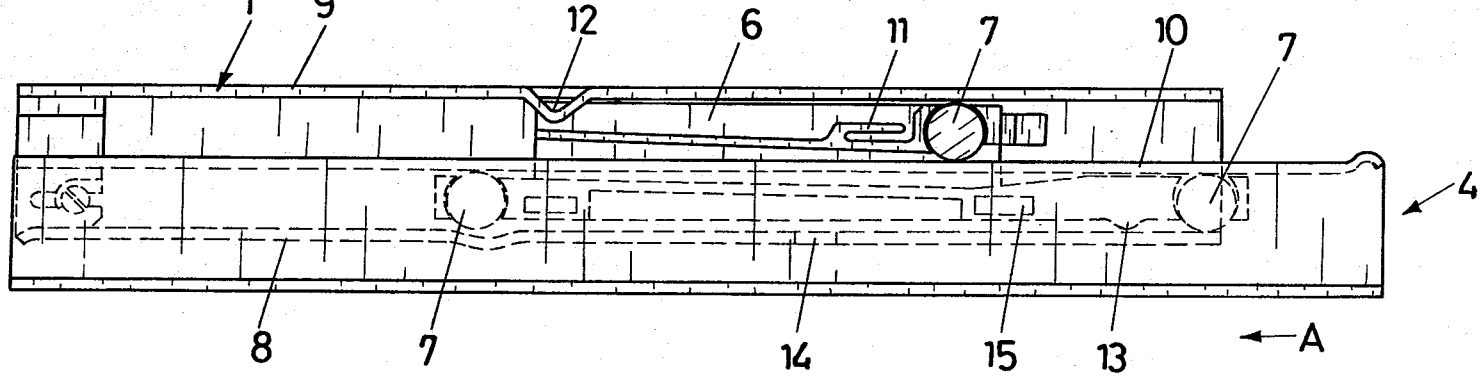
FIG. 2 shows a side view of a withdrawal guide in accordance with the invention.
Figure 3:
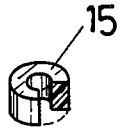
FIG. 3 depicts a plastic stabilization roller in the unloaded state.
Figure 4:
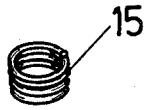
FIG. 4 shows a stabilization roller of metal wire in the unloaded state.
Figure 5:
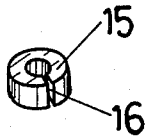
FIG. 5 illustrates a stabilization roller fashioned from a tube.
Figure 6:
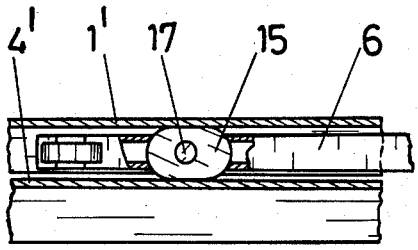
FIG. 6 shows partly in section a schematic plan view of a drawer guide in accordance with the invention with elastic compensating rollers, during the exertion of lateral pressure upon the drawer.

As can be seen in particular from FIG. 1 of the drawing, a roller carrier or roller cage constituted as a mobile unit 6 is disposed in the U-section of the support rail. The mobile unit 6 in question is desirably a plastic injection molding. In the embodiment example three rollers 7 with horizontal axes are carried in the mobile unit 6 in such a way that two rollers 7 run on the supporting track 8 of the support rail 1, while the third roller 7 is located in the zone of the upper horizontal track 9 of the support rail 1 on the fixed structure.

In the fitted position, the upper horizontal track 10 of the guide rail 4 engages between the rollers 7 in such a way that it runs on two rollers, while the uppermost roller 7 secures the horizontal track 10 and thus the guide rail 4 against tilting or tipping upwards.

Through this disposition the guide rail 4 and with it the drawer is held in the support rail 1 secure against tipping.

If the drawer and thus the guide rail 4 is pulled out of the piece of furniture in the direction of the arrow A, the free mobile unit 6 is moved with it.

In the forward zone the flap 11, which is injection molded in one piece with the mobile unit 6, comes to lie under an abutment 12 of the support rail 1.

This abutment 12 is formed on the free edge of the upper horizontal track 9 of the support rail 1 and at the same time constitutes a lateral guide for the mobile unit 6 when the drawer is pulled out.

The first object of the abutment 12 is to prevent the mobile unit 6 from being pulled completely out of the support rail 1 and the second object of the abutment 12 is to prevent the mobile unit 6 from tipping sideways when the drawer is pulled fully out.

If then the drawer is wholly withdrawn, the flap 11 of the mobile unit 6 presses downwards and thus engages the peg 13 constituting a stop in the cut-out 14 of the track 8. In order to make that possible, at least one roller 7, particularly that in the vicinity of the peg 13, is carried in the mobile unit 6 with a vertical play.

Through this arrangement the mobile unit 6 remains held in the support rail 1 and is prevented from falling out when there is no lateral guidance from the drawer.

As can also be seen from the figures of the drawings, compensating rollers 15 are provided in the mobile unit 6, the axes of which are directed normal to the axes of rotation of the rollers 7.

These compensating rollers 15 run when the drawer is pushed in, or the guiding rail 4, first on the vertical track 1' of the support rail 1 and then on the vertical track 4' of the guide rail 4.

The guide rail 4 is thus guided in the support rail 1 by means of rollers both with respect to the load acting vertically and also with regard to the horizontal forces.

The compensating rollers 15 can be made elastically deformable, that is to say, their running faces adapt themselves to the vertical tracks 1' and 4' when the drawer is pushed in, or they exhibit no fixed diameter.

In the installed state the elastic compensating rollers 15 are compressed by the two vertical tracks 1' of the support rail 1 and the vertical tracks 4' of the guide rails 4, so that, for example, they take on an oval form and in practice run in the form of running chains on the two rails.

Through this arrangement an absolutely certain guidance of the drawer is attained in relation to lateral horizontal forces that occur.

Within the framework of the invention the expression compensating roller is to be understood in its widest sense, since the same task could be undertaken also by balls, running chains or the like.

In the same way, the expression axis is to be taken in its widest sense, since the compensating rollers 15 can indeed be carried on an actual mechanical axle, but also as in the embodiment example, can be guided virtually free between the guiding rails, where only the spigots 17 prevent the compensating rollers 15 from falling out when the drawer has been pulled out.

What we claim is:

1. A withdrawal guide for a drawer and the like comprising: fixed support base means; one support rail on said fixed base means for each side of the drawer, one guide rail on the drawer, rollers for transmitting vertical forces occurring between said guide rail and said support rail, a roller carrier for supporting said rollers and comprising a mobile unit, at least one compensating roller in the mobile unit, said compensating roller having an axis of rotation normal to the axis of rotation of said rollers, a vertical track on said support rail said compensating roller running on said vertical track of the support rail and said guide rail respectively, said compensating roller being held only on its peripheral area without an axle being free to move in radial direction to a predetermined degree, peg means to secure the compensating roller to the roller carrier when the drawer guide rail is pulled out of the support rail, said peg means extending only ina lateral recess in said compensating roller, said compensating roller being snapable in and out of its position in the roller carrier.

2. A withdrawal guide as defined in claim 1 including an auxiliary compensating roller in said mobile unit.

3. A withdrawal guide as defined in claim 1 wherein said compensating rollers are elastically deformable perpendicular to the running surface.

4. A withdrawal guide as defined in claim 3 wherein said compensating rollers are comprised of an elastic plastic.

5. A withdrawal guide as defined in claim 3 wherein said compensating rollers are comprised of roller metal.

6. A withdrawal guide as defined in claim 3 wherein said compensating rollers comprise freely deformable rings.

7. A withdrawal guide as defined in claim 3 wherein said compensating rollers comprise a section of a tube.

8. A withdrawal guide as defined in claim 5 wherein said compensating rollers are comprised of spring wire.

9. A withdrawal guide as defined in claim 5 wherein said compensating rollers are rolled from metal bond.

10. A withdrawal guide as defined in claim 7 wherein said section tube has a slit.

* * * * *